US005314753A

United States Patent [19]

Bergmann

[11] Patent Number: 5,314,753

[45] Date of Patent: May 24, 1994

[54] PRINTING PAPER AND A PROCESS FOR ITS MANUFACTURE

[75] Inventor: Werner Bergmann, Brüggen, Fed. Rep. of Germany

[73] Assignee: Stora Feldmühle Aktiengesellschaft, Düsseldorf, Fed. Rep. of Germany

[21] Appl. No.: 974,451

[22] Filed: Nov. 12, 1992

Related U.S. Application Data

[63] Continuation-in-part of Ser. No. 687,896, Jul. 1, 1991, abandoned.

[30] Foreign Application Priority Data

Dec. 7, 1988 [DE] Fed. Rep. of Germany ..... 3841199
Dec. 1, 1989 [WO] PCT Int'l Appl. ..... PCT/EP89/01428

[51] Int. Cl.[5] ..... B32B 23/04

[52] U.S. Cl. ..... 428/511; 106/214; 427/364; 427/391; 427/411; 428/533; 428/537.5

[58] Field of Search ..... 106/213, 214; 427/364, 427/391, 411; 428/511, 512, 532, 533, 535, 537.5

[56] References Cited

U.S. PATENT DOCUMENTS

| | | | |
|---|---|---|---|
| 3,399,074 | 8/1968 | Gottwald et al. | 427/364 X |
| 3,719,514 | 3/1973 | Taylor | 106/210 |
| 3,884,853 | 5/1975 | Zimmerman | 524/47 |
| 5,003,022 | 3/1991 | Nguyen et al. | 527/300 |
| 5,118,533 | 6/1992 | Saji et al. | 427/364 X |

FOREIGN PATENT DOCUMENTS

| | | |
|---|---|---|
| 2605575 | 8/1976 | Fed. Rep. of Germany . |
| 2632744 | 2/1978 | Fed. Rep. of Germany . |

*Primary Examiner*—Michael Lusignan
*Attorney, Agent, or Firm*—Felfe & Lynch

[57] ABSTRACT

A matte printing paper, excepting bank note and security document paper, especially for offset or intaglio printing, is coated with a composition containing calcium carbonate as a coating pigment, a binding agent for absorption of printing ink and 10 to 65% by weight, based on its total solids content, of ungelatinized starch granules, except rice starch granules.

10 Claims, No Drawings

PRINTING PAPER AND A PROCESS FOR ITS MANUFACTURE

This is a continuation-in-part of copending application Ser. No. 07/687,896, filed Jul. 1, 1991, now abandoned.

FIELD OF THE INVENTION

This invention relates to a novel matte printing paper, excepting bank note and security document paper, especially for offset or intaglio printing, with a coating containing calcium carbonate as a coating pigment and a binding agent for the absorption of the printing ink, where the coating contains ungelatinized starch granules, except rice starch granules, in an amount of 10 to 65% by weight, based on its total solids content, as well as to a process for the manufacture of the novel printing paper.

BACKGROUND OF THE INVENTION

German Auslegeschrift No. 12 21 893 discloses the manufacture of coated printing papers, wherein starch is made partially cold-soluble by mechanical treatment in a pug mill, so that in the drying operation performed after the coating it will still be dissolved by the evaporating moisture of the coating composition and as a binding agent will contribute in conventional manner to the fixation of the pigments such as chalk. The manufactured papers are confirmed as having a high gloss. The problem of the resistance of the printing inks to scrubbing is not addressed.

Canadian Patent 1,043,193 (German Patent No. 26 05 575) discloses a bank note paper in which, for the avoidance of fiber separation and for improving resistance to soiling, the surface is provided with a coating which contains as a special plastic binder 0.5 to 10 parts by weight of very fine rice starch, and in some cases additional inorganic pigments. The problem of scrub-resistance does not occur in such papers.

The outstanding suitability of matte, non-glossy printing papers for high-quality printwork, such as art books, advertising folders and business reports, has been increasingly recognized in recent years. Matte printing papers have the great advantage that, on the one hand, the printed products produced with them do not create disturbing light reflections when viewed, and on the other hand, in conjunction with appropriate printing inks, the actual print, especially the polychrome print, has a quite outstanding print gloss, thereby enhancing the quality of the printed product.

For the production of such matte-coated printing papers, the use of calcium carbonate has advanced on a broad front in recent years.

In the German publication, "Wochenblatt fär Papierfabrikation," Vol. 112, No. 17, pages 609 to 613 (1984), the properties of matte-coated papers, including those having calcium carbonate as a coating component, are extensively discussed. In spite of their widespread use since the middle 70's, a great deficiency in regard to scrub-resistance and the formation of glossy streaks is cited as a decided disadvantage of these papers.

Scrub-resistance is to be understood to mean the resistance of a layer of printing ink to mechanical stress by pressure and friction in the further processing of the printed sheet and in the use of the finished printed product.

Even in the case of unprinted papers, however, scrubbing can lead to undesired gloss effects in the finishing machines of the paper mill, such as crosscutters, for example, so that the usefulness of a matte-coated paper can thus be reduced to zero.

Various measures are proposed in the above-cited literature to improve scrub-resistance, but all are relatively difficult to realize or they make the end product expensive, for example if the finished printing sheet is coated with an additional matte lacquer finish. The proposed measures still have not led to a satisfactory solution.

OBJECTS OF THE INVENTION

It is therefore an object of the present invention to make available a matte-coated printing paper which will have an improved scrub-resistance and less sensitivity to glossy streaking.

Other objects and advantages of the invention will become apparent as the description thereof proceeds.

DESCRIPTION OF THE INVENTION

For the achievement of the object, the invention provides a matte printing paper, excepting bank note and security document paper, especially for offset or intaglio printing, with a coating containing calcium carbonate, a coating pigment and a binding agent for the absorption of the printing ink, where the coating contains ungelatinized starch granules, except rice starch granules, in an amount of 10 to 65% by weight, based on the total solids content.

It has surprisingly been found that, through the concomitant use, in accordance with the invention, of ungelatinized starch granules, which are present in the coating as a coating pigment in the amount of 10 to 65% by weight with respect to the dry content of the coating, for the purpose of absorbing the printing ink, in which case the coating contains calcium carbonate as an additional pigment, a paper suitable for the production of high-quality print work can be manufactured, whose scrub-resistance and sensitivity to the development of glossy streaks is substantially improved.

While such papers for offset printing formerly did not have to be treated by calendering for the achievement of greater smoothness, since the offset printing process does not place great demands on the smoothness of the matte paper, the use of such papers for intaglio printing was possible only if very deficient printing results were acceptable in printing products of lesser value. The intaglio printing process places great demands on the surface of a coated paper as regards smoothness and flatness of the coating. If it was desired to achieve greater smoothness for intaglio printing papers in the case of the calcium carbonate-containing coating compositions known heretofore, it has been necessary to subject the coated paper to a subsequent calendering. With supercalenders common in the paper industry the smoothness could be achieved, but this improvement invariably entailed an increase in gloss, and in the final analysis the matte effect here desired could not be achieved.

With the paper coated in accordance with the invention, even smooth but not glossy papers, as needed especially for large-run printed products, can now be made available for the intaglio printing process.

The printing paper according to the invention preferably contains starch granules whose gelatinization temperature is elevated by a known chemical modification.

Such a modification is very preferably achieved by using esterified or etherified starch granules. The gelatinization temperature can be influenced by the selection of the degree of etherification or esterification.

The size of the starch granules is best selected according to the average size of the calcium carbonate pigment. Preferred are starch granules with an average granule diameter of 7 μm to 50 μm, but especially preferred are starch granules with an average granule diameter of 15 to 25 μm. The choice can be made by the known separating techniques, such as the hydrocyclone sorting according to German Offenlegungsschrift 23 41 570.

The following are especially suitable as ungelatinized starch granules: corn-starch, potato starch, wheat starch, rye starch or tapioca starch. However, corn-starch or potato starch are especially preferred, since they are readily available and inexpensive.

The coating for absorbing the printing ink can contain, in addition to 25 to 70% by weight of calcium carbonate and 10 to 65% by weight of ungelatinized starch granules, additional white pigments known and common in the paper coating art. For instance, common coating kaolins, titanium dioxide for improving whiteness and opacity, satin white for whiteness improvement, gypsum as an inexpensive pigment from flue gas desulfuration apparatus, talc, but also known synthetic pigments based on silicate, aluminum oxide or plastics. The proportion of these pigments should preferably not exceed 15% by weight with respect to the solids content of the coating, all ingredients, including binding agents and adjuvants, making up 100% by weight.

A process according to the invention for the manufacture of the printing paper of the invention comprises coating one or both sides of a common raw coating paper having a specific mass of 30 to 170 g/m$^2$ atro (absolutely dry) with a coating composition by the conventional coating techniques, such as roller application, airknife, wire or squeegee or doctor blade, at an application rate of 8 to 24 g/m$^2$ (calculated as parts by weight, atro), the coating composition containing, in addition to calcium carbonate, 10 to 65% by weight of ungelatinized starch granules, with respect to its solids content. The coating composition contains as additional components 5 to 14% by weight, preferably less than 10% by weight of common binding agents such as plastic lattices, gelatinized, degraded starch, or other known binding agents of the paper coating art, dispersants, and optionally additional white pigments and viscosity regulators. The solid content of this coating composition is adjusted to 40 to 72% by weight, preferably to 55 to 63% by weight. The viscosity of this coating composition is adjusted to 500 to 4000 m Pas, measured with the Brookfield viscosimeter, No. 4 spindle, at 50 rpm. A higher viscosity is preferred for roller application and a lower viscosity for metering rod application, airknife or blade application, the adjustment of the viscosity being accomplished by the addition of conventional, known water-soluble polymers, such as polyvinyl alcohol, carboxymethylcellulose or polyacrylic acid derivatives. The pH of the coating composition to be applied amounts to 8 to 10, preferably 8.8 to 9.2, and is established in the preparation of the coating composition, by the application of alkali if necessary. In the preparation of the coating composition it has proven to be especially preferable to add the ungelatinized starch to the mixture as the last component so as to avoid excessive shearing of the starch granules. If greater amounts of starch granules are added to the mixture, it is expedient to increase the content of inorganic or organic dispersants to 0.5 to 1 part by weight, for I have found that native ungelatinized starch results in a more viscous flow of the coating composition.

After the application and evening out of the coating composition, the paper coated with it is dried by known drying methods, such as infrared radiators, hot-air hanging dryers or cylinder dryers, to a dry content of 92 to 96% (absolutely dry), and is then cut to the desired roll or format width.

If the coated paper thus manufactured is to be used for intaglio printing it is subjected to a conventional calender treatment, wherein 2 to 8 passes through the roller gap at a line pressure of 50 to 400 da N/cm on the paper produce the necessary smoothness without causing any marked increase in gloss.

If matte coated printing papers with a greater specific mass in the range from 80 to 250 g/m$^2$ end weight are desired, it is indicated to apply to the raw coating paper first a so-called prime coat and then to provide on this prime coat the actual matte coat for the absorption of the printing ink.

A common prime coat formula contains, for example, as calcium carbonate pigment, 100 parts by weight of ground chalk with a granule size 70% <2 μm, 10 parts by weight oxidized, gelatinized starch, and 9 parts by weight (absolutely dry) of a styrene-butadiene plastic binder as binding agent, as well as additional adjuvants to control the pH and the viscosity. The solid content of such a prime coat composition is adjusted to 55 to 72 parts by weight (absolutely dry), depending on the method of application of the prime coating unit, the application on each side being selected between 6 and 15 g/m$^2$ (absolutely dry).

The process according to the invention can be employed for the manufacture of matte papers coated on one or both sides.

The following examples illustrate the present invention and will enable others skilled in the art to understand it more completely. It should be understood, however, that the invention is not limited solely to the particular examples given below.

A PRIME COAT FORMULA 100 parts by weight ground calcium carbonate
10 parts by weight oxidized starch
9 parts by weight butadiene-styrene latex (abs. dry)
0.5 parts by weight urea formaldehyde resin as a wet-strength agent
pH 9.0
solid content 60.4%
Brookfield viscosity, No. 4 spindle
5100 m Pas at 50 rpm

B COATING FORMULA FOR ABSORPTION OF THE PRINTING INK COATING

Example 1

80 parts by weight ground calcium carbonate
20 parts by weight chemically modified native corn-starch
0.7 parts by weight dispersant
3 parts by weight oxidatively degraded starch
6 parts by weight butadiene-styrene latex (abs. dry)
1 parts by weight calcium stearate
Solid content: 60.5 wt-%
pH: 9.0

Example 2

60 parts by weight ground calcium carbonate
40 parts by weight chemically modified native cornstarch
The rest of the proportions as in Example 1.

Solid content: 57.0 wt.-%
pH: 9.1

Example 3

50 parts by weight ground calcium carbonate
50 parts by weight chemically modified native cornstarch
The rest of the proportions as in Example 1
Solid content: 56.1 wt.-%
pH: 9.0

C EXAMPLE FOR COMPARISON 100 parts by weight ground calcium carbonate
0.4 parts by weight carboxymethylcellulose
0.9 parts by weight polyvinyl alcohol
10 parts by weight plastic latex binder
0.5 parts by weight urea formaldehyde resin
Solid content: 62.6 wt.-%
pH: 9.0

A wood-free raw coating paper with a specific weight of 67 g/m$^2$ was first coated on each side with 11 g/m$^2$ (absolutely dry) of prime composition and then dried. After that, in an additional operation, 13 g/m$^2$ (absolutely dry) of the coating compositions of Examples 1 to 3, and also the coating composition for comparison, were applied to each side and dried. A portion of the papers thus coated was additionally treated afterwards with a laboratory calender to achieve a smooth surface. The testing of the samples and the results obtained are set forth in the following table.

TABLE

| | Spec. Vol. cm$^3$/g | Gloss 75° | Smoothness Bekk-Sec. | IGT-Lifting Test |
|---|---|---|---|---|
| Example 1 | | | | |
| uncalandered | 1.18 | 14 | 12 | |
| calandered | 0.892 | 38 | 490 | 3+ |
| Example 2 | | | | |
| uncalandered | 1.14 | 4 | 12 | |
| calandered | 0.886 | 21 | 595 | 2-3 |
| Example 3 | | | | |
| uncalandered | 1.19 | 3 | 9 | |
| calandered | 0.892 | 15 | 484 | 3+ |
| Comparative Example | | | | |
| uncalandered | 1.08 | 26 | 50 | |
| calandered | 0.858 | 54 | 905 | 3 |

The coated papers have each a specific mass of 115 g/m$^2$, measured according to DIN 53102 and ISO 536. The specific volume was measured according to DIN 53105, the smoothness according to DIN 53107 and the gloss was measured with the gloss measuring apparatus according to Lehmann, at an angle of reflection of 75 degrees.

The determination of the lifting test was performed according to the information sheet on the IGT instrument, the evaluation being made with the aid of an evaluating scale of 1 to 6.

To test the scrub-resistance, first prints were made with the unsatinated samples of Examples to 3 and of the sample for comparison, with a definite amount of ink, so-called weighed prints, using the Prüfbau sample printing press. After the printing ink was thoroughly dried for a period of at least 24 hours, the scrub-resistance test was made with the Oser scrub-resistance test instrument, under defined conditions. The printed surface is scrubbed against the same side or the back of the paper, unprinted areas in each case, for a period of 3 minutes with a load of 625 g. The evaluation can be made visually or by contrast measurement with the Elrepho apparatus at the unprinted area. The result of the visual evaluation was the following rating of the examples, on a scale of 1 to 6.

Rating of the Examples:

| Example | |
|---|---|
| 1 | Grade 2 |
| 2 | Grade 1 |
| 3 | Grade 1 |
| Example for comparison | Grade 5 |

From the above table it can be seen that the examples in accordance with the invention, both in the unsatinated and in the satinated state, have a substantially lower gloss than the Example for Comparison, and that, as the content of native ungelatinized starch in the coating composition increases, the matting effect increases but the sensitivity of the unsatinated, dried coating to glossy streaking does not increase. If, however, the coated paper is satinated, the gloss does not increase substantially above the level of the unsatinated example, but a sufficient increase in smoothness can be obtained, which makes the printing paper in accordance with the invention suitable for the intaglio printing process.

While the present invention has been illustrated with the aid of certain specific embodiments thereof, it will be readily apparent to others skill in the art that the invention is not limited to these particular embodiments, and that various changes and modifications may be made without departing from the spirit of the invention or the scope of the appended claims.

I claim:

1. A matte printing paper consisting essentially of a raw coating paper coated with a coating composition containing 25 to 70% by weight of calcium carbonate as a coating pigment, 10 to 65% by weight of ungelatinized starch granules, except rice starch granules, and no more than 15% by weight of a binding agent for the absorption of printing ink, based on the total weight of said coating composition.

2. A printing paper of claim 1, where the starch granules are chemically modified.

3. A printing paper of claim 2, where the starch granules are etherified.

4. A printing paper of claim 2, where the starch granules are esterified.

5. A printing paper of claim 1, where the starch granules have an average granule diameter of 7 to 50 μm.

6. A printing paper of claim 1, where the starch granules consist of potato starch, corn-starch, wheat starch, rye starch, or tapioca starch or a mixture of two or more of these.

7. A printing paper of claim 1, where the coating contains, in addition to calcium carbonate, kaolin, titanium dioxide satin white, gypsum, talc or other common natural or synthetic white pigments.

8. A printing paper of claim 1, where the coating contains ground or precipitated calcium carbonate.

9. In the method of manufacturing a matte printing paper by applying a coating composition contained 25 to 70% of calcium carbonate and no more than 15% by weight of a binding agent to a raw coating paper which has been provided with a prime coat, and drying the coated paper, the improvement which resides in that said coating composition contains 10 to 65% by weight of ungelatinized starch granules, based on the total weight of said coating composition, and the starch granules are not added to the coating composition until after all the other components have been added.

10. The method of manufacturing a printing paper of claim 9, wherein subsequent to the drying of the coating, the printing paper is smoothed by a conventional calendering treatment.

* * * * *